US005315961A

United States Patent [19]

Wichelhaus

[11] Patent Number: 5,315,961

[45] Date of Patent: May 31, 1994

[54] HYDRAULIC VALVE TAPPET FOR AN INTERNAL-COMBUSTION ENGINE

[75] Inventor: Donatus Wichelhaus, Börtlingen, Fed. Rep. of Germany

[73] Assignee: Dr. Ing. h.c.F. Porsche AG, Fed. Rep. of Germany

[21] Appl. No.: 979,866

[22] PCT Filed: Aug. 16, 1991

[86] PCT No.: PCT/EP91/01554

§ 371 Date: Feb. 26, 1993

§ 102(e) Date: Feb. 26, 1993

[87] PCT Pub. No.: WO92/04531

PCT Pub. Date: Mar. 19, 1992

[30] Foreign Application Priority Data

Aug. 31, 1990 [DE] Fed. Rep. of Germany ..... 4027630

[51] Int. Cl.[5] ..... F01L 9/02; F01L 9/04; F01L 25/02

[52] U.S. Cl. ..... 123/90.11; 123/90.12; 123/90.48; 251/57; 251/129.01; 137/909

[58] Field of Search ..... 123/90.11, 90.12, 90.48; 137/909; 251/57, 129.01

[56] References Cited

U.S. PATENT DOCUMENTS

| | | | |
|---|---|---|---|
| 4,840,112 | 6/1989 | Bhadra et al. | 137/909 |
| 4,930,463 | 6/1990 | Hare, Sr. | 123/90.11 |
| 5,014,829 | 5/1991 | Hare, Sr. | 123/90.11 |
| 5,099,884 | 3/1992 | Monahan | 123/90.11 |
| 5,103,779 | 4/1992 | Hare, Sr. | 123/90.11 |
| 5,158,109 | 10/1992 | Hare, Sr. | 137/909 |
| 5,161,653 | 11/1992 | Hare, Sr. | 137/909 |

FOREIGN PATENT DOCUMENTS

| | | |
|---|---|---|
| 0196441 | 10/1986 | European Pat. Off. . |
| 0238942 | 9/1987 | European Pat. Off. . |
| 3625627 | 2/1988 | Fed. Rep. of Germany . |
| 3718393 | 8/1988 | Fed. Rep. of Germany . |
| 3724655 | 8/1988 | Fed. Rep. of Germany . |
| 2189086 | 10/1987 | United Kingdom . |

OTHER PUBLICATIONS

*Automotive Engineering* by David Scott and Jack Yamaguchi entitled "Solidifying Fluid Transforms Clutches and Flow Valves", pp. 61–66, Nov. 1983.

*SAE Technical Paper Series* by T. Ahmad and M. A. Theobald entitled "A Survey of Variable-Valve-Actuation Technology", Aug. 1989.

*Primary Examiner*—Tony M. Argenbright
*Assistant Examiner*—Weilun Lo
*Attorney, Agent, or Firm*—Evenson, McKeown, Edwards & Lenahan

[57] ABSTRACT

A hydraulic valve tappet for an internal-combustion engine has a high-pressure valve through which an electroviscous fluid flows as a function of an electric voltage. In this case, a piston is displaced which is connected with a charge cycle valve so that the valve stroke is continuously variable. Using an electronic control device, the valve stroke is influenced as a function of parameters of the internal-combustion engine.

10 Claims, 2 Drawing Sheets

HYDRAULIC VALVE TAPPET FOR AN INTERNAL-COMBUSTION ENGINE

BACKGROUND AND SUMMARY OF THE INVENTION

This invention relates to a valve tappet for an internal-combustion engine and, more particularly, to a hydraulic valve tappet for an internal-combustion engine, having a housing which is disposed in a receiving device and having a piston which is displaceably guided in this housing. The piston is connected with a charge cycle valve.

Tappets of this type are used for the transmission of forces acting between the camshaft and the intake and the exhaust valves. In modern high-performance internal-combustion engines, cup-shaped valve tappets are frequently used which are disposed in the cylinder head to be directly displaceable between the cams and the valves. These are usually connected to the oil circulating system and cause a hydraulic valve clearance compensation which renders respective servicing operations superfluous, as known, for example, from the German Patent Document DE-37 24 655.

For improving the torque, the emission, the fuel consumption and the idling quality, it is known to design the valve stroke and/or the valve overlap to be variable. A cam-controlled valve tappet which influences the valve stroke using a hydraulic arrangement is disclosed, for example, in the German Patent Document DE-36 25 627. The tappet shown there is in an operative connection with a charge cycle valve by way of a hydraulic space. For the variation of the valve stroke, a portion of the hydraulic fluid can be discharged from the hydraulic space by a control valve.

A survey of variable valve actuating mechanisms is disclosed in SAE Paper 891674, "A Survey of Variable Valve Actuation Technology".

From the journal *Automotive Engineering*, Volume 91, Number 11, 1983, Pages 61–66, it is known to construct a valve, through which an electroviscous fluid (EVF) flows, of several cylinder shells which are arranged coaxially with respect to one another and which are spaced with respect to one another by radially extending struts. This valve is inserted as a piston into a hydraulic cylinder through which an EVF flows. This fluid flows axially through the cylinder shells in an unimpaired manner so that the piston remains in its position. By the feeding of an electric field, the viscosity of the EVF can be changed arbitrarily within a very short time period from liquid to solid. In this case, the flow resistance between the cylinder shells increases so that the piston is displaced by the afterflow of fluid into the hydraulic cylinder.

From the German Patent Document DE-36 09 861, it is known to utilize the two electrodes and the EVF-layer disposed in-between as a movement sensor for the control and regulation of a hydraulic EVF-system (Oppermann effect). As a function of the flow rate of the EVF between the electrodes, a flow signal is generated in the electrodes which is fed to an electronic circuit which supplies a corresponding output voltage to the electrodes and therefore, in turn, affects the viscosity. The movement sensor therefore, at the same time, represents the control element for influencing the movement.

There is therefore needed a hydraulic valve tappet for an internal-combustion engine by means of which the valve stroke can be varied during the operation of the internal-combustion engine.

This need is met by a hydraulic valve tappet for an internal-combustion engine, having a housing which is disposed in a receiving device and having a piston which is displaceably guided in this housing. The piston is connected with a charge cycle valve. A rigid hydraulic high-pressure valve is fastened in the housing. A variable operating space is formed between the high-pressure valve and the piston, which is filled with a fluid. The viscosity of the fluid can be changed by the feeding of an electric voltage.

This valve tappet permits a continuous variation of the valve stroke of a charge cycle valve by the arrangement of a rigid high-pressure valve, that is, a high-pressure valve which has no moving parts, and of an operating space which is formed between this high-pressure valve and the displaceable piston and is filled with a fluid the viscosity of which can be changed by the feeding of an electric voltage.

Such an electroviscous fluid (EVF) can be changed with respect to its viscosity by means of the electric voltage from "liquid" to "hard". A voltage which is fed to the high-pressure valve builds up an electric field which penetrates the fluid and causes it to solidify. For varying the valve stroke, the fluid, when a cam moves onto the valve tappet, is at first liquid so that the piston is displaced by the transmitted forces and in the process fluid is displaced out of the operating space through the high-pressure valve. When the desired valve stroke is reached, the fluid solidifies into a firm medium and, because of the short switching times for the viscosity change (milliseconds), the now rigid connection between the cam and the piston opens the charge cycle valve.

In an advantageous development, the displaced fluid is pushed into a compensating space formed between the high-pressure valve and a housing bottom which is acted upon by the cam, so that the fluid will remain inside the valve tappet; its volume is therefore low. When the cam moves off the housing bottom, the viscosity is changed to "liquid", and a spring arranged between the housing bottom and a sealing disk covering the compensation space displaces the fluid through the high-pressure valve back into the operating space.

The remaining fluid inside the valve tappet avoids the problems which normally occur in the case of oil-hydraulic tappets as a result of foamed oil, such as tappet rattling and resulting noises which simulate combustion noises at or above the knock limit to a knock control.

The required electronic voltage is transmitted in a no-contact manner by induction windings inserted into the valve tappet housing and into a tappet guide. An electronic control device controls the electric voltage and thus the valve stroke. Because of the Oppermann effect, the tappet is self-regulating since, when the fluid is displaced through the cylinder shells, a voltage is induced which is a function of the displacement rate and which transmits the actual valve stroke to the switching circuit. For certain parameters of the internal-combustion engine, such as the load, the rotational speed, and the oil temperature, optimal valve strokes are stored in characteristic diagrams in the control device. Thus, as a function of the parameter, a valve stroke can be implemented in each case which is optimal, for example, with respect to a minimal emission of pollutants or a maximal performance.

The control may take place individually for each charge cycle valve. In the case of an internal-combustion engine equipped with, for example, two intake valves per cylinder, the two valves can open successively with different strokes in phase-shifted manner. Furthermore, for a low, consumption-optimized power range of the internal-combustion engine, one of the two intake valves may be disconnected in that the adjusting path of the piston in the housing is selected to be as long as the maximal cam pitch, and the viscosity at the point of the maximal cam pitch is adjusted to "solid".

The tappet can be used, for example, as a cup tappet in a displaceable manner directly between the cam and the charge cycle valve, or it may be used as a stationarily disposed tappet. In the case of the stationary arrangement, for example, as a base for a rocker lever or rocker arm, the tappet guide and the induction windings will not be necessary because, in this case, the high-pressure valve is connected directly to the electronic control device.

Irrespectively, the valve tappet causes an automatic valve clearance compensation in every case, for example, in the case of a positive control. This results in lower manufacturing and servicing expenditures.

Other objects, advantages and novel features of the present invention will become apparent from the following detailed description of the invention when considered in conjunction with the accompanying drawings.

DETAILED DESCRIPTION OF THE DRAWINGS

Figure 1:
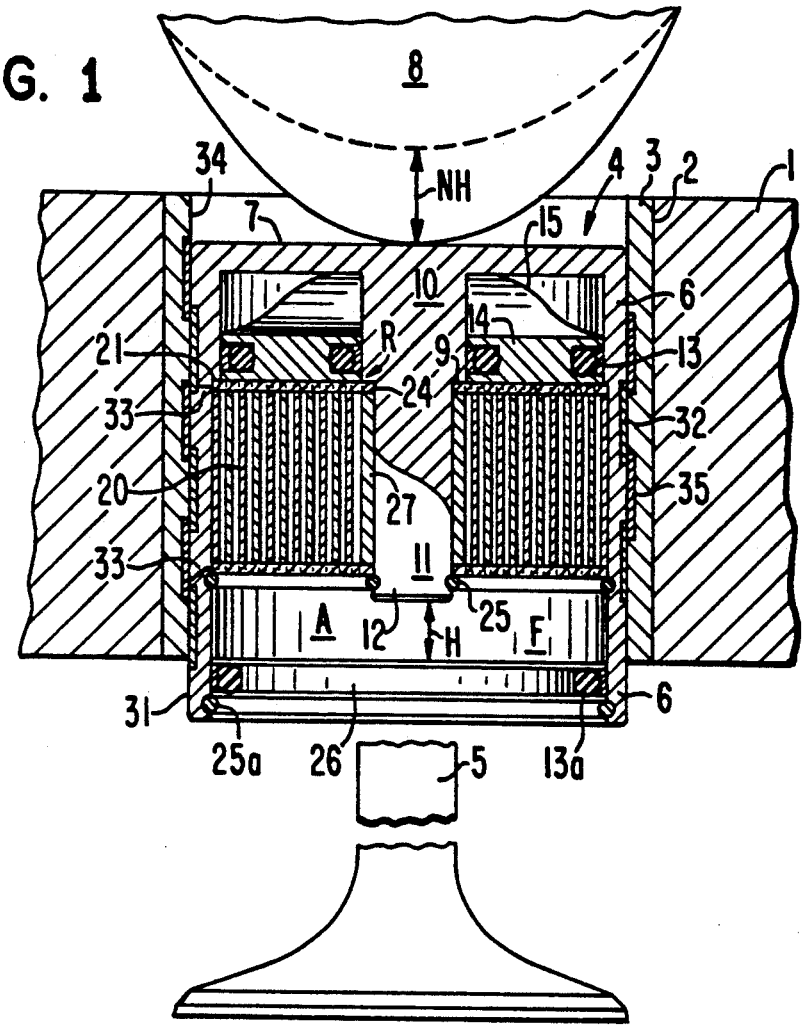
FIG. 1 is a partial sectional view of a cylinder head having a valve tappet.

In a cylinder head 1 of an internal-combustion engine, which is not shown in detail, a hydraulic valve tappet, which is constructed as a cup tappet 4, is displaceably disposed in a receiving device 2 by a hollow-cylindrical tappet guide 3 and acts upon a charge cycle valve 5 which is illustrated only in an outlined manner.

The tappet 4 has a cup-shaped housing 6 with a housing bottom 7 which is in direct contact with a cam 8 of a camshaft which is only outlined. A pin 12, which is separated into two sections 10, 11 by a step 9 and is connected on one side with the bottom 7, extends axially in the center of the housing 6. A sealing disk 14, which is inserted by means of two sealing rings 13 and can be displaced axially on the pin 12, extends radially between the first section 10 and the housing 6. On one side, it is acted upon by a diaphragm spring 15 which is supported on the bottom 7. A rigid hydraulic high-pressure valve 20, which has no moving parts and rests against the step 9 and a corresponding stop 21 in the housing 6, extends between the second section 11 and the housing 6. The upper and lower side 22 and 23 (FIG. 2) of the valve 20 are each bounded by a valve disk 24. Axial displacements of the valve 20 are prevented by retaining rings 25 fixed on the pin 12 and in the housing 6.

A piston 26, which is secured from falling out by another retaining ring 25*a* and acts upon the charge cycle valve 5 of the internal-combustion engine, is displaceably inserted into the housing 6 by means of another sealing ring 13*a*.

Figure 2:
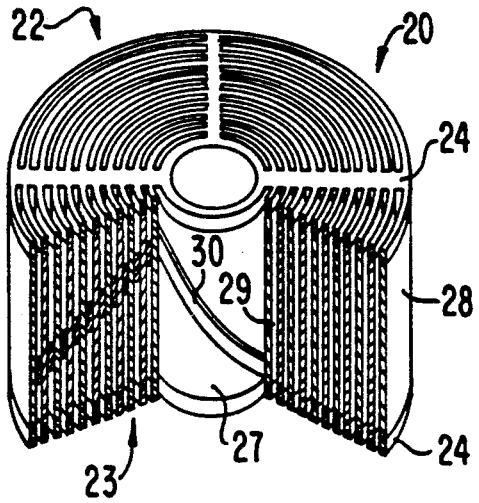
FIG. 2 is a perspective view of a high-pressure valve of the valve tappet.

As shown in FIG. 2, the high-pressure valve 20 consists of a core sleeve 27, which is pushed onto the pin 12, and of several cylinder shells 28 which are arranged coaxially and at a distance from one another, one flow duct 29 respectively being created between two adjacent shells 28, in which a helical insulator bridge 30 is mounted.

An insulated induction winding 32, which extends helically in the outer lateral surface 31 of the housing 6, is embedded in this surface 31 and, by way of electrically conductive connections 33, is connected to the cylinder shells 28 in such a manner that the latter act as a plate capacitor.

Figure 3:
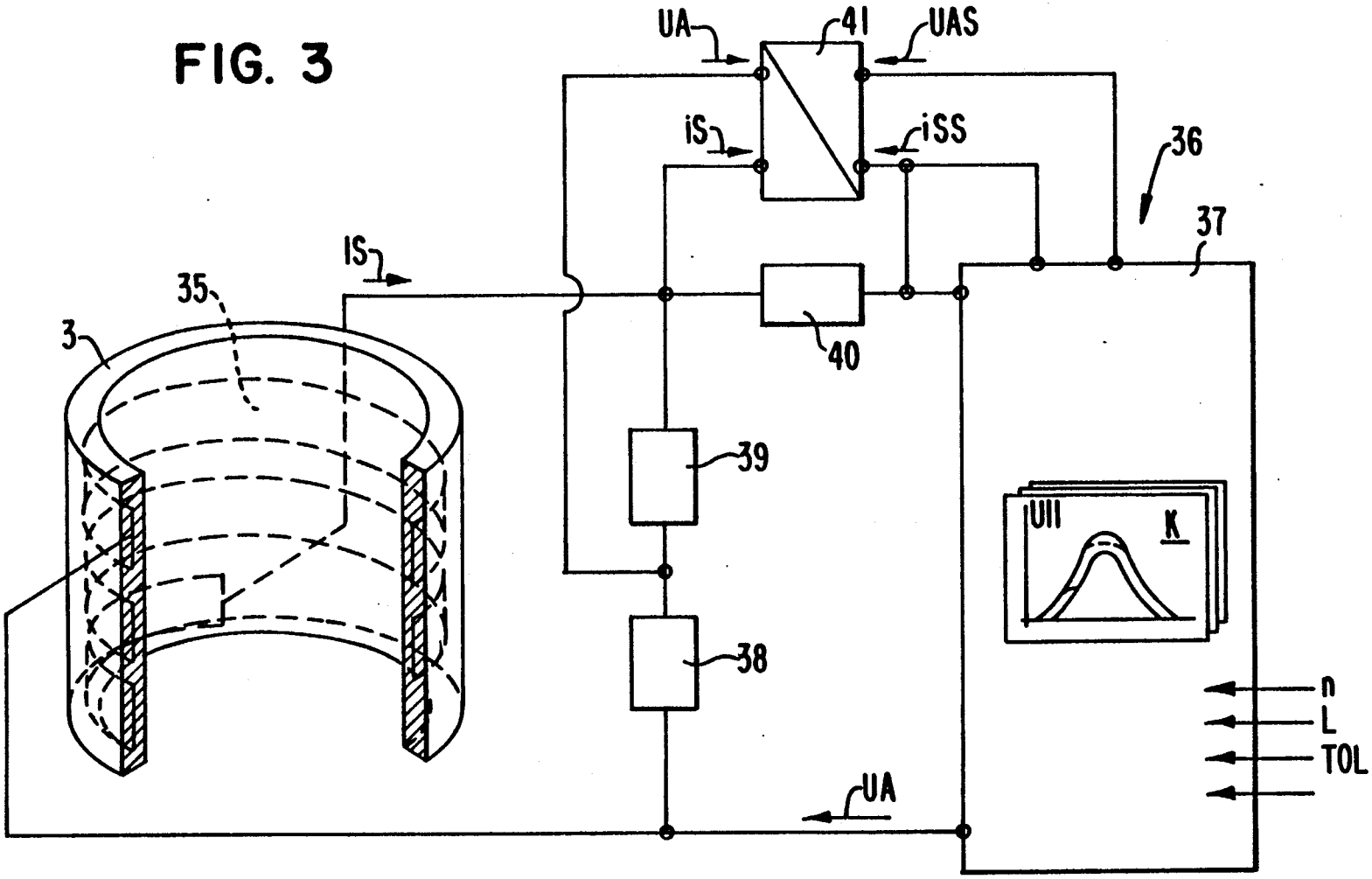
FIG. 3 is a perspective view of a tappet guide with a schematic electric switching circuit.

On its guide surface 34, the electrically insulating tappet guide 3 also has a helically extending, insulated induction winding 35 which is connected to an electronic control device 36 which will be explained in the following and is schematically illustrated in FIG. 3.

Between the bottom side 23 and the piston 26, an operating space A is formed which, like the flow ducts 29 connected with it, is filled with an electroviscous fluid F. Inside this operating space A, the piston 26 can be displaced by a path which corresponds to the variable valve stroke H of the charge cycle valves.

The sealing disk 14 is displaceable between the top side 22 and the housing bottom 7 by at least the stroke H, a compensating space R being formed between the disk 14 and the top side 22.

Referring to FIG. 3, the control device 36 comprises a high-voltage module 37 which is controlled by, among others, characteristic diagrams K. In these characteristic diagrams K, voltage values UH are stored which correspond to a certain valve stroke H, as a function of the load L, the rotational speed n and the oil temperature TÖl of the internal-combustion engine. The high-voltage module 37 supplies an output voltage UA to the induction winding 35 of the tappet guide 3.

During the operation of the internal-combustion engine, the cup tappet 4 is moved back and forth in the stationary tappet guide 3 by the rotating cam 8 or by a valve spring which is not shown. As a result of this movement, a voltage UI is induced in the induction winding 32 and is fed to the cylinder shells 28 by way of the connections 33. This voltage UI can be influenced by way of the ratio of the number of induction windings 32 to the number of windings 35. The electric field, which acts between the shells 28 and penetrates the fluid F, changes its viscosity into the "solid" direction; that is, the piston 26 and the sealing disk 14 remain in the position illustrated in FIG. 1 for a maximal valve stroke H. The output voltage UA is measured continuously by way of a voltage resistor 38 which is connected in series with a bias voltage resistor 39, which acts as a reference resistor, in parallel to the induction winding 35. Because of the low electric conducting capacity of the fluid F, a current flow IS, which corresponds to the solid condition, will flow continuously and is measured by way of a flow measuring resistor 40. The values of UA and IS are then fed to a comparator 41 which compares these UA, IS values with the desired UAS and ISS values stored in the characteristic diagram K and, if necessary, intervenes in a correcting manner.

When, for example, because of the load information, a switching to a different valve stroke H is to take place, the high-voltage module 37 lowers the output voltage UA to such an extent that the viscosity of the fluid F changes in the "liquid" direction. During the next rotation of the cam 8, the housing 6 is therefore displaced relative to the piston 26, in which case, by means of the reduction of the operating space A, fluid F is displaced along the flow ducts 29 into the compensating space R. In this case, the sealing disk 14 is shifted in the direction of the housing bottom 7 against the spring force of the diaphragm spring 15.

In this case, the fluid F is guided helically along the insulator bridges 30 through the flow ducts 29. This helical course lengthens the path by which the fluid F is displaced in the flow ducts 29 and, as a result, together with a relative rough surface of the cylinder shells 28, increases the adhesion of the fluid F and thus the force that can be transmitted. In order to guide a uniform volume flow through all flow ducts 29, the insulator bridges 30 extend in a steeper fashion with an increasing radius of the cylinder disks 28.

The flow which is measured by the flow measuring resistor 40 during the displacement of the piston 26 deviates from the flow IS which flows when the fluid is solid because the electric conducting capacity of the fluid F is a function of its flow rate in the high-pressure valve 20. The voltage UA, which is measured by the voltage measuring resistor 38, changes with the flow change. When then the comparator 41 reports a coinciding of the voltage UA with the desired voltage UAS required for the desired valve stroke H, the displacement of the piston 26 is terminated by the fact that the high-voltage module 37 supplies an output voltage UA and causes the fluid F to solidify again.

When the cam 8 moves off the housing bottom 7, the viscosity is again changed to "liquid" so that the diaphragm spring 15 displaces the sealing disk 14 and, as a result, the fluid F travels out of the compensating space R through the flow ducts 29 into the working space A and displaces the piston 26. Thus, when the charge cycle valve 5 is closed, the contact is maintained between the cam 8 and the housing bottom 7 or the piston 26 and the charge cycle valve 5 as well as in the case of known hydraulic cup tappets.

In the high-voltage module 37, additional characteristic diagrams K may be stored in which various cam shapes are filed as voltage courses UH which correspond to them. In this case, various maximal strokes and/or various cam flanks can be implemented. In the case of strokes that are lower than the maximal valve stroke, the opening speed of charge cycle valve 5 can be affected, for example, by the change of viscosity as a function of the speed of the voltage change.

When the displacement path of the piston 26 in the housing 6 is selected to be as long as the cam pitch NH of the cam 8, during the operation of the internal-combustion engine, the charge cycle valve 5 connected with the tappet 4 can be disconnected. In this case, the housing 6 is displaced by the cam pitch NH with respect to the piston 26 and is held in this condition at the point of the maximal pitch by the feeding of a voltage UA. The hydraulic valve tappet may also be used in timing gears of internal-combustion engines, in which the cams do not act directly on a cup tappet which is in direct contact with a charge cycle valve. It can be displaced, for example, also in the case of a bumper control, between the bumper and the cam or between the bumper and the rocker arm, or can be used in the case of a rocker lever or rocker arm control as a stationary base of the rocker lever or rocker arm. In the case of a stationary arrangement, the tappet guide 3 and the induction winding 32 may be eliminated because, in this case, the high-pressure valve 20 is connected directly to the control device 36.

Although the invention has been described and illustrated in detail, it is to be clearly understood that the same is by way of illustration and example, and is not to be taken by way of limitation. The spirit and scope of the present invention are to be limited only the terms of the appended claims.

I claim:

1. A hydraulic valve tappet, for an internal combustion engine, having a housing disposed in a receiving device and a piston displaceably guided in the housing, said piston being connected with a charge valve cycle, comprising:

a rigid hydraulic high-pressure valve fastened in the housing;

a variable operating space formed between the high-pressure valve and the piston, said operating space being filled with a fluid having a viscosity; and wherein the viscosity of the fluid is changed by feeding an electric voltage to it;

a compensating space which is formed between a bottom of said housing and the high-pressure valve and is connected with the operating space; and a sealing disk, which is acted upon on one side by a spring and is arranged in the compensating space in an axially displaceable manner.

2. A tappet according to claim 1, further comprising a pin which extends centrically in the housing and is connected on one side with a bottom of the housing, the high-pressure valve extending radially between the pin and the housing.

3. A tappet according to claim 2, wherein the high-pressure valve comprises several cylinder shells which are arranged coaxially and at a distance from one another and through which the fluid flows axially.

4. A tappet according to claim 3, wherein helically extending insulator bridges are arranged between the cylinder shells.

5. A tappet according to claim 2, wherein the high-pressure valve is bounded by a valve disk on one of its top side and bottom side which faces the housing bottom and the piston, respectively.

6. A tappet according to claim 1, wherein induction windings are embedded in an insulated manner in an exterior lateral surface of the housing.

7. A tappet according to claim 1, wherein the housing is inserted into a hollow-cylindrical tappet guide which is arranged in the receiving device.

8. A tappet according to claim 7, wherein induction windings are embedded in an insulated manner in a guide surface of the tappet guide.

9. A tappet according to claim 1, wherein the high-pressure valve is created in an electric connection with an electronic control device which supplies the electric voltage.

10. A tappet according to claim 9, wherein the control device comprises characteristic diagrams in which courses of voltages are stored which correspond to various strokes as a function of parameters of the internal-combustion engine.

* * * * *